US007951768B2

(12) United States Patent
Boutique et al.

(10) Patent No.: US 7,951,768 B2
(45) Date of Patent: May 31, 2011

(54) LAUNDRY DETERGENT COMPOSITIONS COMPRISING AMPHIPHILIC GRAFT POLYMERS BASED ON POLYALKYLENE OXIDES AND VINYL ESTERS

(75) Inventors: Jean-Pol Boutique, Gembloux (BE); James Lee Danziger, Bad Soden (DE); Frank Hulskotter, Bad Duerkheim (DE); Frederik Vandenberghe, Gentgrugge (BE); Robb Richard Gardner, Cincinnati, OH (US); Arturo Luis Casado-Dominguez, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/147,864

(22) Filed: Jun. 27, 2008

(65) Prior Publication Data

US 2009/0005287 A1 Jan. 1, 2009

Related U.S. Application Data

(60) Provisional application No. 60/937,818, filed on Jun. 29, 2007.

(51) Int. Cl.
*C11D 3/37* (2006.01)
*C11D 1/00* (2006.01)
*C11D 3/43* (2006.01)

(52) U.S. Cl. ..... 510/475; 510/276; 510/336; 510/337; 510/342; 510/360; 510/403; 510/405; 510/505

(58) Field of Classification Search ..... 510/276, 510/336, 337, 342, 360, 403, 405, 475, 505
See application file for complete search history.

(56) References Cited

U.S. PATENT DOCUMENTS

| | | | | |
|---|---|---|---|---|
| 5,049,302 | A | 9/1991 | Holland et al. | |
| 5,733,856 | A | 3/1998 | Gopalkrishnan et al. | |
| 6,455,486 | B1 * | 9/2002 | Kerobo et al. | 510/421 |
| 7,163,985 | B2 | 1/2007 | Ortiz et al. | |
| 7,465,701 | B2 | 12/2008 | Sharma et al. | |
| 2006/0270582 | A1 | 11/2006 | Boeckh et al. | |
| 2008/0015135 | A1 * | 1/2008 | de Buzzaccarini et al. | 510/336 |
| 2008/0300158 | A1 | 12/2008 | Schutz et al. | |
| 2009/0023625 | A1 | 1/2009 | Tang et al. | |

FOREIGN PATENT DOCUMENTS

| | | | |
|---|---|---|---|
| EP | 0219048 | A2 | 4/1987 |
| EP | 0285038 | A2 | 4/1987 |
| EP | 0285935 | A1 | 10/1988 |
| EP | 358474 | * | 3/1990 |
| EP | 0358474 | A2 | 3/1990 |
| EP | 0692520 | A1 | 1/1996 |
| WO | WO 02/15865 | A2 | 2/2002 |
| WO | WO 02/18526 | A1 | 3/2002 |
| WO | WO 2005/035706 | A2 | 4/2005 |
| WO | WO 2006/130442 | A1 | 12/2006 |
| WO | WO 2006/130575 | A2 | 12/2006 |
| WO | WO 2007/138053 | A1 | 12/2007 |
| WO | WO 2007/138054 | A1 | 12/2007 |
| WO | WO 2008/007320 | A2 | 1/2008 |

OTHER PUBLICATIONS

PCT International Search Report Mailed Oct. 10, 2008.

* cited by examiner

*Primary Examiner* — Brian P Mruk
(74) *Attorney, Agent, or Firm* — Stephen T. Murphy; Leonard W. Lewis; Steve W. Miller

(57) ABSTRACT

A laundry detergent composition comprising an amphiphilic graft polymer based on water-soluble polyalkylene oxides as a graft base and side chains formed by polymerization of a vinyl ester component, said polymer having an average of less than or equal to one graft site per 50 alkylene oxide units and a mean molar mass of from about 3,000 to about 100,000; from about 0.2% to about 8% of organic solvent; and from about 2% to about 20% of a surfactant system; wherein said detergent composition is in a form selected from: liquid; gel; and combinations thereof.

20 Claims, No Drawings

LAUNDRY DETERGENT COMPOSITIONS COMPRISING AMPHIPHILIC GRAFT POLYMERS BASED ON POLYALKYLENE OXIDES AND VINYL ESTERS

CROSS REFERENCE TO RELATED APPLICATION

This application claims priority to U.S. Provisional Application Ser. No. 60/937,818, filed Jun. 29, 2007.

FIELD OF THE INVENTION

The present disclosure relates to laundry detergent compositions, including but not limited to those in liquid and gel forms, containing amphiphilic graft polymers based upon water-soluble polyalkylene oxides.

BACKGROUND OF THE INVENTION

Consumers desire laundry detergents including, but not limited to those in liquid and gel forms, that provide excellent overall cleaning. The detergent industry typically utilizes surfactants, among other things, to deliver this benefit. Due to increasing environmental sensitivity, as well as rising cost, the wide spread use of surfactants may be losing favor. Consequently, detergent manufacturers are examining ways to reduce the dosage of surfactant in the wash liquor, while still providing the consumer with excellent overall cleaning.

One approach for reducing surfactant dosage is to formulate laundry detergents with polymers. Like surfactants, polymers may be useful as releasers of soil from fabric. In addition, or in the alternative, some polymers may provide for suspension of soils dispersed in the wash liquor, which in turn may prevent their deposition back onto the fabrics being washed. However, some of these polymers may lose at least a portion of their efficacy when combined with the surfactants that they are meant to, at least in part, replace.

It would therefore be desirable to provide laundry detergent compositions comprising polymers that provide for good suspension of soils, such as greasy soils and the like, even in the presence of surfactants. Such laundry detergent compositions would provide for good cleaning even when formulated with low levels of surfactants and organic solvents. It would be also desirable to provide such laundry detergent compositions with multiple polymer systems that further provide for both good soil suspension and soil removal. Such a detergent composition would particularly be desirable if used in conjunction with fabric softeners, such as cationic coacervating polymers for example, which may drive deposition of soils onto fabrics. Moreover, it would also be desirable to provide these laundry detergent compositions in forms such as liquids, gels and combinations thereof.

SUMMARY OF THE INVENTION

New amphiphilic graft polymers based on polyalkylene oxides and vinyl esters are described in co-pending patent application, published in PCT Patent Application WO 2007/138054A1. These amphiphilic graft polymers are found to provide excellent hydrophobic soil suspension. Surprisingly, it has been found that by incorporating these polymers into laundry detergent compositions, overall surfactant levels may be reduced, yet the general cleaning capability of the resulting detergent is substantially the same, if not better. This may particularly be the case in detergent compositions comprising surfactant systems having high levels of anionic surfactant including, but not limited to, linear alkylbenzene sulfonic acid. Without wishing to be bound by theory, it is believed that the amphiphilic graft polymers may disrupt micelles and/or vesicles that are formed in the wash liquor between calcium ions and anionic surfactant; the anionic surfactant that would otherwise be "bound" within the micelle/vesicles is thereby made available for cleaning. It has also been surprisingly found that levels of organic solvent may also be reduced, without negatively impacting general cleaning capability. The resulting laundry detergent compositions are disclosed in detail below.

It has also been found that the use of the amphiphilic graft polymers provide further improved cleaning performance when they are incorporated in a multiple polymer system. Polymers such as ethoxysulfated hexamethylene diamine dimethyl quat and the like may be utilized in laundry detergent compositions as hydrophilic stain or soil removers. However, their efficacy may be reduced due to the presence (in the wash liquor and/or on fabric surfaces) of fabric softeners and/or perfume adjuncts including, but not limited to, cationic coacervating polymers. Without being bound by theory, it is believed that the cationic coacervating polymers act as deposition aids and thereby can interfere and/or negate the affects of the hydrophilic stain removers. Yet it has surprisingly been found that by utilizing the aforementioned, new amphiphilic graft polymers in conjunction with polymeric, hydrophilic soil removers, little or no reduction in hydrophilic stain removal is observed. In some embodiments, the optimal weight percentage ratio of amphiphilic graft polymer to ethoxylated hexamethylene diamine dimethyl quat is from about 95:5 to about 10:90, from about 90:10 to about 20:80, or from about 80:20 to about 50:50.

Thus in some embodiments, the present laundry detergent compositions comprise: (a) amphiphilic graft polymer based on water-soluble polyalkylene oxides as a graft base and side chains formed by polymerization of a vinyl ester component; this polymer has an average of less than or equal to one graft site per 50 alkylene oxide units and a mean molar mass of from about 3,000 to about 100,000 and may have a polydispersity of less than or equal to about 3; (b) from about 0.2% to about 8% by weight of organic solvent; and (c) from about 2% to about 40% of a surfactant system.

In further embodiments, the present laundry detergent compositions may comprise a multiple polymer system comprising only two polymers. The two polymer system may in turn comprise a first polymer which acts as a hydrophilic soil remover and a second polymer which acts as a hydrophobic soil suspender. The hydrophobic soil suspender may be an amphiphilic graft polymer as described above. The hydrophilic soil remover may be a polyalkoxylated cationic or zwitterionic polymer having a backbone comprising oligoamine, polyamine, or polyimine; and at least one polyalkoxylated side chain.

Any of the presently disclosed laundry detergent compositions may be in a form selected from: liquid; gel; and mixtures thereof. Moreover, the compositions may be isotropic, anisotropic or combinations thereof.

DETAILED DESCRIPTION OF THE INVENTION

"Soil" and "stain" are used interchangeably herein.

"Fabric" and "textile" are used interchangeably herein.

"Liquid detergent composition" as used herein, refers to compositions that are in a form selected from the group of: "pourable liquid"; "gel"; "cream"; and combinations thereof. The liquid detergent compositions may be anisotropic, isotropic and combinations thereof.

"Pourable liquid" as defined herein refers to a liquid having a viscosity of less than about 2000 mPa*s at 25° C. and a shear rate of 20 $sec^{-1}$. In some embodiments, the viscosity of the pourable liquid may be in the range of from about 200 to about 1000 mPa*s at 25° C. at a shear rate of 20 $sec^{-1}$. In some embodiments, the viscosity of the pourable liquid may be in the range of from about 200 to about 500 mPa*s at 25° C. at a shear rate of 20 $sec^{-1}$.

"Gel" as defined herein refers to a transparent or translucent liquid having a viscosity of greater than about 2000 mPa*s at 25° C. and at a shear rate of 20 $sec^{-1}$. In some embodiments, the viscosity of the gel may be in the range of from about 3000 to about 10,000 mPa*s at 25° C. at a shear rate of 20 $sec^{-1}$ and greater than about 5000 mPa*s at 25° C. at a shear rate of 0.1 $sec^{-1}$.

"Cream" and "paste" are used interchangeably and as defined herein refer to opaque liquid compositions having a viscosity of greater than about 2000 mPa*s at 25° C. and a shear rate of 20 $sec^{-1}$. In some embodiments, the viscosity of the cream may be in the range of from about 3000 to about 10,000 mPa*s at 25° C. at a shear rate of 20 $see^{-1}$, or greater than about 5000 mPa*s at 25° C. at a shear rate of 0.1 $sec^{-1}$.

"Liquid matrix" and "liquid carrier" are used interchangeably herein.

The articles "a", "an" and "the" as used herein refer to "one or more", unless otherwise indicated.

Markush language as used herein encompasses combinations of the individual Markush group members, unless otherwise indicated.

All percentages, ratios and proportions used herein are by weight percent of the composition, unless otherwise specified. All average values are calculated "by weight" of the composition or components thereof, unless otherwise expressly indicated.

Mole percent (mol %) as used herein may mean either the percent of a monomeric unit in relation to all monomeric units of the polymer; or the mole fraction of reagents or reactants based upon other reagents or reactants.

All numerical ranges disclosed herein, are meant to encompass each individual number within the range and to encompass any combination of the disclosed upper and lower limits of the ranges.

The present laundry detergent compositions address the aforementioned problems, among others, through the selection of: (1) amphiphilic graft polymer; (2) a surfactant system; (3) liquid matrix (organic solvent). Additional components may be added to the laundry detergent compositions including, but not limited to: (4) structurant; (5) hydrotrope; (6) soil suspension and/or release polymer; and (7) fabric softener.

(1) Amphiphilic Graft Polymer

The amphiphilic graft polymers of use in the present invention as well as methods of making them are described in detail in PCT Patent Application No. WO 2007/138054. They may be present in the liquid detergent compositions at weight percentages of from about 0.05% to about 10%, from about 0.1% to about 5%, from about 0.2% to about 3%, or from about 0.3% to about 2%. The amphiphilic graft polymers are found to provide excellent hydrophobic soil suspension even in the presence of cationic coacervating polymers.

The amphiphilic graft polymers are based on water-soluble polyalkylene oxides as a graft base and side chains formed by polymerization of a vinyl ester component. These polymers having an average of less than or equal to one graft site per 50 alkylene oxide units and mean molar masses ($M_w$) of from about 3000 to about 100,000.

One method of preparing the amphiphilic graft polymers comprises the steps of: polymerizing a vinyl ester component (B) composed of vinyl acetate and/or vinyl propionate (B1) and, if desired, a further ethylenically unsaturated monomer (B2), in the presence of a water-soluble polyalkylene oxide (A), a free radical-forming initiator (C) and, if desired, up to 40% by weight, based on the sum of components (A), (B) and (C), of an organic solvent (D), at a mean polymerization temperature at which the initiator (C) has a decomposition half-life of from 40 to 500 min, in such a way that the fraction of unconverted graft monomer (B) and initiator (C) in the reaction mixture is constantly kept in a quantitative deficiency relative to the polyalkylene oxide (A).

The graft polymers are characterized by their low degree of branching (degree of grafting); they have, on average, based on the reaction mixture obtained, not more than 1 graft site, preferably not more than 0.6 graft site, more preferably not more than 0.5 graft site and most preferably not more than 0.4 graft site per 50 alkylene oxide units. They comprise, on average, based on the reaction mixture obtained, preferably at least 0.05, in particular at least 0.1 graft site per 50 alkylene oxide units. The degree of branching can be determined, for example, by means of $^{13}C$ NMR spectroscopy from the integrals of the signals of the graft sites and the —$CH_2$-groups of the polyalkylene oxide.

In accordance with their low degree of branching, the molar ratio of grafted to ungrafted alkylene oxide units in the inventive graft polymers is from about 0.002 to about 0.05, or from about 0.002 to about 0.035, or from about 0.003 to about 0.025, or from about 0.004 to about 0.02.

In some embodiments of the inventive graft polymers feature a narrow molar mass distribution and hence a polydispersity $M_w/M_n$ of generally less than or equal to about 3, or less than or equal to about 2.5, or less than or equal to about 2.3. In some embodiments, their polydispersity $M_w/M_n$ is in the range from about 1.5 to about 2.2. The polydispersity of the graft polymers can be determined, for example, by gel permeation chromatography using narrow-distribution polymethyl methacrylates as the standard.

The mean weight average molecular weight $M_w$ of the inventive graft polymers is from about 3000 to about 100,000, or from about 6000 to about 45,000, or from about 8000 to about 30,000.

Other embodiments of the inventive graft polymers may also have only a low content of ungrafted polyvinyl ester (B). In general, they comprise less than or equal to about 10% by weight, or less than or equal to about 7.5% by weight, or less than or equal to about 5% by weight of ungrafted polyvinyl ester (B).

Owing to the low content of ungrafted polyvinyl ester and the balanced ratio of components (A) and (B), the inventive graft polymers are soluble in water or in water/alcohol mixtures (for example a 25% by weight solution of diethylene glycol monobutyl ether in water). They have pronounced, low cloud points which, for the graft polymers soluble in water at up to 50° C., are generally less than or equal to about 95° C., or less than or equal to about 85° C., or less than or equal to about 75° C., and, for the other graft polymers in 25% by weight diethylene glycol monobutyl ether, generally less than or equal to about 90° C., or from about 45 to about 85° C.

Some embodiments or the inventive amphiphilic graft polymers have:

(A) from about 20 to about 70% by weight of a water-soluble polyalkylene oxide as a graft base and (B) side chains formed by free-radical polymerization of from about 30 to about 80% by weight of a vinyl ester component composed of:

(B1) from about 70 to 100% by weight of vinyl acetate and/or vinyl propionate and (B2) from 0 to about 30% by weight of a further ethylenically unsaturated monomer in the presence of (A).

Other embodiments comprise from about 25 to about 60% by weight of the graft base (A) and from about 40 to about 75% by weight of the polyvinyl ester component (B).

Water-soluble polyalkylene oxides suitable for forming the graft base (A) are in principle all polymers based on $C_2$-$C_4$-alkylene oxides which comprise at least about 50% by weight, or at least about 60% by weight, or at least about 75% by weight of ethylene oxide in copolymerized form.

Some embodiments of the polyalkylene oxides (A) may have a low polydispersity, $M_w/M_n$. In some embodiments the polydispersity is less than or equal to about 1.5.

The polyalkylene oxides (A) may be the corresponding polyalkylene glycols in free form, i.e. with OH end groups, but they may also be capped at one or both end groups. Suitable end groups are, for example, $C_1$-$C_{25}$-alkyl, phenyl and $C_1$-$C_{14}$-alkylphenyl groups.

Non-limiting examples of particularly suitable polyalkylene oxides (A) include:

(A1) polyethylene glycols which may be capped at one or both end groups, especially by $C_1$-$C_{25}$-alkyl groups, but are preferably not etherified, and have mean molar masses $M_n$ of preferably from about 1500 to about 20,000, or from about 2500 to about 15,000;

(A2) copolymers of ethylene oxide and propylene oxide and/or butylene oxide with an ethylene oxide content of at least about 50% by weight, which may likewise be capped at one or both end groups, for example by $C_1$-$C_{25}$-alkyl groups, but are not etherified, and have mean molar masses $M_n$ of from about 1500 to about 20,000, or from about 2500 to about 15,000;

(A3) chain-extended products having mean molar masses of from about 2500 to about 20,000, which are obtainable by reacting polyethylene glycols (A1) having mean molar masses $M_n$ of from about 200 to about 5000 or copolymers (A2) having mean molar masses $M_n$ of from about 200 to about 5000 with $C_2$-$C_{12}$-dicarboxylic acids or -dicarboxylic esters or $C_6$-$C_{18}$-diisocyanates. In some embodiments, the graft bases (A) are polyethylene glycols (A1). The side chains of the inventive graft polymers are formed by polymerization of a vinyl ester component (B) in the presence of the graft base (A).

The vinyl ester component (B) may comprise of (B1) vinyl acetate or vinyl propionate or of mixtures of vinyl acetate and vinyl propionate. In some embodiments some preference may be given to vinyl acetate as the vinyl ester component (B).

However, the side chains of the graft polymer can also be formed by copolymerizing vinyl acetate and/or vinyl propionate (B1) and a further ethylenically unsaturated monomer (B2). The fraction of monomer (B2) in the vinyl ester component (B) may be up to about 30% by weight, which corresponds to a content in the graft polymer of (B2) of about 24% by weight.

Suitable comonomers (B2) are, for example, monoethylenically unsaturated carboxylic acids and dicarboxylic acids and their derivatives, such as esters, amides and anhydrides, and styrene. It is of course also possible to use mixtures of different comonomers.

Specific, non-limiting examples include (meth)acrylic acid, $C_1$-$C_{12}$-alkyl and hydroxy-$C_2$-$C_{12}$-alkyl esters of (meth) acrylic acid, (meth)acrylamide, N—$C_1$-$C_{12}$-alkyl(meth) acrylamide, N,N-di($C_1$-$C_6$-alkyl)(meth)acrylamide, maleic acid, maleic anhydride and mono($C_1$-$C_{12}$-alkyl)esters of maleic acid.

Some monomers (B2) are the $C_1$-$C_8$-alkyl esters of (meth) acrylic acid and hydroxyethyl acrylate. In some embodiments particular preference may be given to $C_1$-$C_4$-alkyl esters of (meth)acrylic acid. Some embodiment may use methyl acrylate, ethyl acrylate, or n-butyl acrylate. When the inventive graft polymers comprise the monomers (B2) as a constituent of the vinyl ester component (B), the content of graft polymers in (B2) may be from about 0.5 to about 20% by weight, or from about 1 to about 15% by weight, or from about 2 to about 10% by weight.

Without intending to be limited by theory, it is believed that the amphiphilic graft polymers operate by co-micellization with the surfactants.

(2) Surfactant System

Any suitable surfactant system may be of use in the present invention. The surfactant system may be present in the liquid detergent compositions at weight percentages of from about 2% to about 40%, from about 5% to about 30%, or from about 10% to about 25%. Surfactant that may be used for the present invention may comprise a surfactant or surfactant system comprising surfactants selected from nonionic, anionic, cationic surfactants, ampholytic, zwitterionic, semi-polar nonionic surfactants, other adjuncts such as alkyl alcohols, or mixtures thereof.

Anionic Surfactants

Nonlimiting examples of anionic surfactants useful herein include: $C_8$-$C_{18}$ alkyl benzene sulfonates (LAS); $C_{10}$-$C_{20}$ primary, branched-chain and random alkyl sulfates (AS); $C_{10}$-$C_{18}$ secondary (2,3) alkyl sulfates; $C_{10}$-$C_{18}$ alkyl alkoxy sulfates ($AE_xS$) wherein preferably x is from 1-30; $C_{10}$-$C_{18}$ alkyl alkoxy carboxylates preferably comprising 1-5 ethoxy units; mid-chain branched alkyl sulfates as discussed in U.S. Pat. No. 6,020,303 and U.S. Pat. No. 6,060,443; mid-chain branched alkyl alkoxy sulfates as discussed in U.S. Pat. No. 6,008,181 and U.S. Pat. No. 6,020,303; modified alkylbenzene sulfonate (MLAS) as discussed in WO 99/05243, WO 99/05242, and WO 99/05244; methyl ester sulfonate (MES); and alpha-olefin sulfonate (AOS).

Nonionic Co-Surfactants

Non-limiting examples of nonionic co-surfactants include: $C_{12}$-$C_{18}$ alkyl ethoxylates, such as, NEODOL® nonionic surfactants from Shell and LUTENSOL® XL and LUTENSOL® XP from BASF; $C_6$-$C_{12}$ alkyl phenol alkoxylates wherein the alkoxylate units are a mixture of ethoxy and propoxy units; $C_{12}$-$C_{18}$ alcohol and $C_6$-$C_{12}$ alkyl phenol condensates with ethylene oxide/propylene oxide block alkyl polyamine ethoxylates such as PLURONIC® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1-30, as discussed in U.S. Pat. No. 6,153,577, U.S. Pat. No. 6,020,303 and U.S. Pat. No. 6,093,856; Alkylpolysaccharides as discussed in U.S. Pat. No. 4,565,647 Llenado, issued Jan. 26, 1986; specifically alkylpolyglycosides as discussed in U.S. Pat. No. 4,483,780 and U.S. Pat. No. 4,483,779; Polyhydroxy fatty acid amides as discussed in U.S. Pat. No. 5,332,528; and ether capped poly(oxyalkylated) alcohol surfactants as discussed in U.S. Pat. No. 6,482,994 and WO 01/42408.

Non-limiting examples of semi-polar nonionic co-surfactants include: water-soluble amine oxides containing one alkyl moiety of from about 10 to about 18 carbon atoms and 2 moieties selected from the group consisting of alkyl moieties and hydroxyalkyl moieties containing from about 1 to about 3 carbon atoms; water-soluble phosphine oxides containing one alkyl moiety of from about 10 to about 18 carbon atoms and 2 moieties selected from the group consisting of alkyl moieties and hydroxyalkyl moieties containing from about 1 to about 3 carbon atoms; and water-soluble sulfoxides containing one alkyl moiety of from about 10 to about 18 carbon atoms and a moiety selected from the group consisting of alkyl moieties and hydroxyalkyl moieties of from about 1 to about 3 carbon atoms. See WO 01/32816, U.S. Pat. No. 4,681,704, and U.S. Pat. No. 4,133,779.

In some embodiments, surfactant of the detergent products of the present invention includes at least one anionic surfactant and at least one nonionic surfactant. In some embodiments, the detergent products of the present invention may also include other surfactants such as zwitterionic, ampholytic or cationic type or can comprise compatible mixtures of these types in conjunction with the anionic surfactant and nonionic surfactant.

Non-limiting examples of suitable anionic surfactants are selected from: linear alkylbenzene sulfonic acid; branched alkybenzene sulfonic acid; C12 to C18 alkylsulfate; C12-C18 alkyl alkoxy sulfate; C12-C18 alkyl methyl ester sulfonate and combinations thereof.

Further surfactants useful herein include those described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980.

Anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) the sodium, potassium and ammonium alkyl polyethoxylate sulfates, particularly those in which the alkyl group contains from about 10 to about 22, or from about 12 to about 18 carbon atoms, and wherein the polyethoxylate chain contains from 1 to about 15, or 1 to about 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Also useful are linear straight chain alkylbenzene sulfonates in which the average number of carbon atoms in the alkyl group is from about 11 to about 13, abbreviated as $C_{11-13}$ LAS.

In one embodiment, nonionic surfactants useful herein include those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. In one embodiment, the nonionic surfactants are condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol.

Additional suitable nonionic surfactants include polyhydroxy fatty acid amides of the formula:

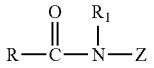

wherein R is a $C_{9-17}$ alkyl or alkenyl, $R_1$ is a methyl group and Z is glycidyl derived from a reduced sugar or alkoxylated derivative thereof. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference.

(3) Aqueous Liquid Matrix

The liquid detergent compositions according to the present invention also contain an aqueous liquid matrix. Generally the amount of the liquid matrix employed in the compositions herein will be relatively large, often comprising the balance of the detergent composition, but can comprise from about 5 wt % to about 85 wt % by weight of the detergent composition. Preferably, the compositions of the present invention comprise from about 20% to about 80% of an aqueous liquid matrix.

The most cost effective type of aqueous, non-surface active liquid matrix is, of course, water itself. Accordingly, the aqueous, non-surface active liquid matrix component will generally be mostly, if not completely, comprised of water. While other types of water-miscible liquids, such as $C_1$-$C_3$ alkanolamines such as mono-, di- and triethanolamines, and the like, have been conventionally been added to liquid detergent compositions as neutralizers, hydrotropes, or stabilizers. Thickeners, if desired, may also be utilized, such as Polygel DKP®, a polyacrylate thickener from ex 3V Co. If utilized, phase stabilizers/co-solvents can comprise from about 0.1% to 5.0% by weight of the compositions herein.

$C_1$-$C_3$ lower alkanols may also be used as organic solvents in the liquid matrices of use in the present invention. The organic solvents that may be used include, but are not limited to, organic solvents that are liquid at room temperature and consist essentially of atoms selected from carbon; hydrogen; oxygen; and combinations thereof. Non-limiting examples of suitable organic solvents include ethanol; 1,2 propanediol; glycerol; diethylene glycol; 2-methyl 1,3 propanediol; and combinations thereof. When used, the solvent may comprise from about 0.2% to about 8%, preferably from about 0.5% to about 5%, by weight of the laundry detergent composition, of an organic solvent (4) Structurant Any suitable structurant may be utilized in the liquid detergent compositions of the present invention. In some embodiments, structurant(s) may be present in the compositions at a weight percentage of from about 0.05% to about 0.8%, or from about 0.1% to about 0.4%.

One type of structuring agent which is especially useful in the compositions of the present invention comprises non-polymeric (except for conventional alkoxylation), crystalline hydroxy-functional materials which can form thread-like structuring systems throughout the liquid matrix when they are crystallized within the matrix in situ. Such materials can be generally characterized as crystalline, hydroxyl-containing fatty acids, fatty esters or fatty waxes. Such materials will generally be selected from those having the following formulas:

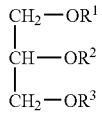

I)

wherein:

-continued $R^1$ is $-\overset{O}{\overset{\|}{C}}-R^4$;

$R^2$ is $R^1$ or H;

$R^3$ is $R^1$ or H;

$R^4$ is independently $C_{10}$-$C_{22}$ alkyl or alkenyl comprising at least one hydroxyl group;

II)

$$R^7-\overset{O}{\overset{\|}{C}}-OM$$

wherein:

$R^7$ is $-\overset{O}{\overset{\|}{C}}-R^4$;

$R^4$ is as defined above in i);

M is $Na^+$, $K^+$, $Mg^{++}$ or $Al^{3+}$, or H; and

III)

$$Z\text{-}(CH(OH))a\text{-}Z'$$

where a is from 2 to 4, preferably 2; Z and Z' are hydrophobic groups, especially selected from $C_6$-$C_{20}$ alkyl or cycloalkyl, $C_6$-$C_{24}$ alkaryl or aralkyl, $C_6$-$C_{20}$ aryl or mixtures thereof. Optionally Z can contain one or more nonpolar oxygen atoms as in ethers or esters.

Materials of the Formula I type are preferred. They can be more particularly defined by the following formula:

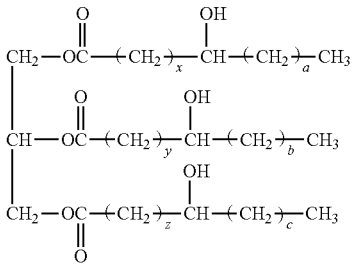

wherein:

(x+a) is from between 11 and 17;
(y+b) is from between 11 and 17; and
(z+c) is from between 11 and 17.
Preferably, in this formula x=y=z=10 and/or a=b=c=5.

Specific examples of preferred crystalline, hydroxyl-containing structurants include castor oil and its derivatives. Examples include mixtures of hydrogenated castor oil and its hydrolysis products, e.g. hydroxy stearic acid. Especially preferred are hydrogenated castor oil derivatives such as hydrogenated castor oil and hydrogenated castor wax. Commercially available, castor oil-based, crystalline, hydroxyl-containing structurants include THIXCIN® from Rheox, Inc. (now Elementis).

Alternative commercially available materials that are suitable for use as crystalline, hydroxyl-containing structurants are those of Formula III hereinbefore. An example of a structurant of this type is 1,4-di-O-benzyl-D-Threitol in the R,R, and S,S forms and any mixtures, optically active or not.

All of these crystalline, hydroxyl-containing structurants as hereinbefore described are believed to function by forming thread-like structuring systems when they are crystallized in situ within the aqueous liquid matrix of the compositions herein or within a pre-mix which is used to form such an aqueous liquid matrix. Such crystallization is brought about by heating an aqueous mixture of these materials to a temperature above the melting point of the structurant, followed by cooling of the mixture to room temperature while maintaining the liquid under agitation.

Under certain conditions, the crystalline, hydroxyl-containing structurants will, upon cooling, form the thread-like structuring system within the aqueous liquid matrix. This thread-like system can comprise a fibrous or entangled thread-like network. Non-fibrous particles in the form of "rosettas" may also be formed. The particles in this network can have an aspect ratio of from 1.5:1 to 200:1, more preferably from 10:1 to 200:1. Such fibers and non-fibrous particles can have a minor dimension which ranges from 1 micron to 100 microns, more preferably from 5 microns to 15 microns.

These crystalline, hydroxyl-containing materials are especially preferred structurants for providing the detergent compositions herein with shear-thinning rheology. They can effectively be used for this purpose at concentrations which are low enough that the compositions are not rendered so undesirably opaque that bead visibility is restricted. These materials and the networks they form also serve to stabilize the compositions herein against liquid-liquid or solid-liquid (except, of course, for the beads and the structuring system particles) phase separation. Their use thus permits the formulator to use less of relatively expensive non-aqueous solvents or phase stabilizers which might otherwise have to be used in higher concentrations to minimize undesirable phase separation. These preferred crystalline, hydroxyl-containing structurants, and their incorporation into aqueous shear-thinning matrices, are described in greater detail in U.S. Pat. No. 6,080,708 and in PCT Publication No. WO 02/40627.

Other types of organic external structurants, besides the non-polymeric, crystalline, hydroxyl-containing structurants described hereinbefore, may be utilized in the liquid detergent compositions herein. Polymeric materials which will provide shear-thinning characteristics to the aqueous liquid matrix may also be employed.

Suitable polymeric structurants include those of the polyacrylate, polysaccharide or polysaccharide derivative type. Polysaccharide derivatives typically used as structurants comprise polymeric gum materials. Such gums include pectine, alginate, arabinogalactan (gum Arabic), carrageenan, gellan gum, xanthan gum and guar gum.

If polymeric structurants are employed herein, a preferred material of this type is gellan gum. Gellan gum is a heteropolysaccharide prepared by fermentation of Pseudomonaselodea ATCC 31461. Gellan gum is commercially marketed by CP Kelco U.S., Inc. under the KELCOGEL tradeneme. Processes for preparing gellan gum are described in U.S. Pat. Nos. 4,326,052; 4,326,053; 4,377,636 and 4,385,123.

Of course, any other structurants besides the foregoing specifically described materials can be employed in the aqueous liquid detergent compositions herein, provided such other structurant materials produce compositions having the selected theological characteristics hereinbefore described. Also combinations of various structurants and structurant types may be utilized, again so long as the resulting aqueous matrix of the composition possesses the hereinbefore specified pour viscosity, constant stress viscosity and vicosity ratio values.

In some embodiments the structurants include, but are not limited to, those organic external structurant selected from the group consisting of a. non-polymeric crystalline, hydroxy-functional materials which form thread-like structuring systems throughout the aqueous liquid matrix of said composition upon in situ crystallization therein;

b. polymeric structurants selected from polyacrylates, polymeric gums, other non-gum polysaccharides, and combinations thereof, said polymeric structurants imparting shear thinning characteristics to the aqueous liquid matrix of said composition;

c. any other structurant which imparts to the aqueous liquid matrix of said liquid composition a pouring viscosity at 20 $sec^{-1}$ of from 100 cps to 2500 cps; a viscosity at constant low stress of 0.1 Pa which is at least 1500 cps, and a ratio of said constant low stress viscosity to said pouring viscosity of at least 2; and d. combinations of said external structurant types.

(5) Hydrotrope

Any suitable hydrotrope may be of use in the present detergent compositions. In some embodiments, anionic hydrotropes are utilized and are present at from about 0.1% to about 5%, or from about 0.2% to about 3%, or from about 0.5% to about 2%, by weight of the detergent composition. Suitable anionic hydrotropes may be selected from a sulfonic acid or sodium sulfonate salt of toluene, cumene, xylene, napthalene or mixtures thereof.

(6) Hydrophilic Soil Removal Polymers

Any suitable hydrophilic soil removal polymer or polymers may be of use in the present invention. By hydrophilic soil removal polymer it is meant a polymer which is hydrophilic itself and which acts to help removal and suspension of hydrophilic soils from fabrics. One class of preferred soil removal polymers as used herein are polyalkoxylated, cationic or zwitterionic, polymers having a backbone comprising oligoamine, polyamine, or polyimine; and at least one polyalkoxylated side chain. A suitable soil removal polymer, preferred for the present invention may be selected from the group consisting of:

ethoxylated oligoamines such as ethoxylated tetraethylene pentaimine, ethoxylated oligoamine methyl quats such as ethoxylated hexamethylene diamine dimethyl quat or bis(hexamethylene)triamine ethoxylated about 30 times per —NH group and about 90% quaternized, ethoxylated oligoamine benzyl quats such as benzyl quat of ethoxylated bis(hexamethylene)triamine, ethoxylated oligoamine methyl quats such as ethoxysulfated hexamethylene diamine dimethyl quat or ethoxysulfated bis(hexamethylene)triamine quat, propoxylated-ethoxylated oligoamine methyl quats such as propoxylated, ethoxylated methyl quat of hexamethylene diamine, ethoxysulfated oligoamine benzyl quats such as partially sulfated benzyl quat of ethoxylated bis(hexamethylene) triamine, propoxylated-ethoxysulfated oligoamine benzyl quats such as propoxylated, ethoxylated and benzyl-quaternized and trans-sulfated bis(hexamethylene)triamine, ethoxylated oligoetheramine methyl quats, ethoxylated oligoetheramine benzyl quats, ethoxysulfated oligoetheramine methyl quats such as ethoxylated 4,9-dioxa-1,12-dodecanediamine dimethyl quat tetrasulfate, ethoxysulfated oligoetheramine benzyl quats, ethoxylated polyethyleneimines such as ethoxylated polyethyleneimine having an average of between about 5 and about 25 ethoxylations per —NH group, ethoxylated polyethyleneimine quats such as methyl quaternized, ethoxylated polyethyleneimine having an average of between about 5 and about 25 ethoxylations per —NH group, ethoxylated-propoxylated polyethyleneimines such as ethoxylated and propoxylated polyethyleneimine having an average of between 5 and 25 ethoxylations per —NH group and between 5 and 10 propoxylations per —NH group, ethoxylated-propoxylated polyethyleneimine quats, and combinations thereof.

Another hydrophilic soil removal polymer which may be used in the present invention are polymers comprising polyacrylic acid monomers having a number average molecular weight of from about 1000 to about 10,000 and a polydispersity of less than about 5 as disclosed in PCT Patent Application No. WO2007/149806.

(7) Fabric Softener

The detergent compositions of the present invention may further comprise fabric softeners. In some embodiments, the fabric softener may comprise cationic coacervating polymers. Cationic coacervating polymers of use in the present invention are selected from: cationic hydroxyl ethyl cellulose; polyquaternium polymers; and combinations thereof.

(8) Buffers and Neutralizing Agents

The present detergent compositions may have any suitable overall pH. Non-limiting examples of suitable overall pH ranges include from about 6.5 to about 11 or from about 7.5 to about 10. Buffers and neutralizing agents may be utilized in the detergent compositions of the present invention in varying proportions to achieve the desired overall pH. Non-limiting examples of buffers and neutralizers of use include NaOH and lower alkanolamines. Non-limiting examples of useful lower alkanolamines include: monoethanolamine; diethanolamine; and triethanolamine. Note that although the lower alkanolamines could generally be considered as "organic solvents," for the purpose of clarity in the presently disclosed detergent formulations, all such materials are NOT to be counted as "organic solvents".

EXAMPLES

For the purposes of illustration only, and not be construed as limiting, the following examples of the liquid laundry detergent compositions of the present invention are provided below. The laundry detergent compositions may made using any suitable method.

TABLE 1

| | Percentage by weight of composition | | | | | |
|---|---|---|---|---|---|---|
| Ingredient | A | B | C | D | E | F |
| Alkylbenzene sulfonic acid | 7 | 7 | 4.5 | 1.2 | 1.5 | 12.5 |
| Sodium C12-14 alkyl ethoxy 3 sulfate | 2.3 | 2.3 | 4.5 | 4.5 | 7 | 18 |
| C14-15 alkyl 8-ethoxylate | 5 | 5 | 2.5 | 2.6 | 4.5 | 4 |
| C12 alkyl dimethyl amine oxide | — | 2 | — | — | — | — |
| C12-14 alkyl hydroxyethyl dimethyl ammonium chloride | — | — | — | 0.5 | — | — |
| C12-18 Fatty acid | 2.6 | 3 | 4 | 2.6 | 2.8 | 11 |
| Citric acid | 2.6 | 2 | 1.5 | 2 | 2.5 | 3.5 |
| Protease enzyme | 0.5 | 0.5 | 0.6 | 0.3 | 0.5 | 2 |
| Amylase enzyme | 0.1 | 0.1 | 0.15 | — | 0.05 | 0.5 |
| Mannanase enzyme | 0.05 | — | 0.05 | — | — | 0.1 |
| PEG-PVAc Polymer[1] | 1 | 0.8 | 1 | 0.4 | 0.5 | 2.7 |

TABLE 1-continued

| Ingredient | Percentage by weight of composition | | | | | |
|---|---|---|---|---|---|---|
| | A | B | C | D | E | F |
| Ethoxysulfated Hexamethylene Diamine Dimethyl Quat | — | — | 0.4 | — | 1.5 | — |
| Ethoxylated Hexamethylene Diamine dimethyl quat | — | — | — | 0.4 | — | — |
| Ethoxylated Polyethylenimine[2] | — | — | — | — | — | 0.5 |
| Diethylenetriaminepenta (methylenephosphonic) acid | 0.2 | 0.3 | — | — | 0.2 | — |
| Hydroxyethane diphosphonic acid | — | — | 0.45 | — | — | 1.5 |
| FWA | 0.1 | 0.1 | 0.1 | — | — | 0.2 |
| Solvents (1,2 propanediol, ethanol), stabilizers | 3 | 4 | 1.5 | 1.5 | 2 | 4.3 |
| Sodium Cumene Sulfonate | — | — | 1.0 | — | — | — |
| Hydrogenated castor oil derivative structurant | 0.4 | 0.3 | 0.3 | 0.1 | 0.3 | — |
| Boric acid | 1.5 | 2 | 2 | 1.5 | 1.5 | 0.5 |
| Na formate | — | — | — | 1 | — | — |
| Reversible protease inhibitor[3] | — | — | 0.002 | — | — | — |
| Perfume | 0.5 | 0.7 | 0.5 | 0.5 | 0.8 | 1.5 |
| Buffers (sodium hydroxide, Monoethanolamine) | To pH 8.2 | | | | | |
| Water and minors (antifoam, aesthetics, etc.) | To 100 | | | | | |

[1]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.
[2]Polyethylenimine (MW = 600) ethoxylated 20 times.
[3]Reversible Protease inhibitor of structure

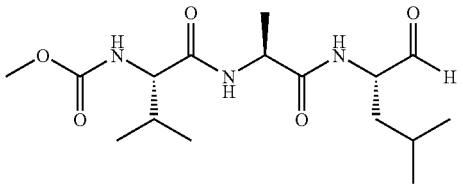

TABLE 2

Other liquid detergent compositions according to the invention.
Table 1

| Ingredient | Percentage by weight of composition | | | | | |
|---|---|---|---|---|---|---|
| | G | H | I | J | K | L |
| Alkylbenzene sulfonic acid | 5.5 | 2.7 | 2.2 | 7.4 | 12.2 | 2.5 |
| Sodium C12-14 alkyl ethoxy 3 sulfate | 16.5 | 20 | 9.5 | 17.3 | 7.7 | 5.2 |
| Sodium C12-14 alkyl sulfate | 8.9 | 6.5 | 2.9 | — | — | — |
| C12-15 alkyl 9-ethoxylate | 1.7 | 0.8 | 0.3 | 15.3 | 18.1 | 3.4 |
| C12-18 Fatty acid | 2.2 | 2.0 | — | 1.4 | 1.3 | 0.1 |
| Citric acid | 3.5 | 3.8 | 2.2 | 2.9 | 2.4 | — |
| Protease enzyme | 1.7 | 1.4 | 0.4 | 2.4 | — | — |
| Amylase enzyme | 0.4 | 0.3 | — | 0.1 | — | — |
| PEG-PVAc Polymer[1] | 2.1 | 1.2 | 1.0 | 3 | 2 | 0.9 |
| Ethoxysulfated Hexamethylene Diamine Dimethyl Quat | 0.9 | 1.2 | 0.4 | 3 | 2 | 0.4 |
| Ethanol | 3 | 2.6 | 1.2 | 2.6 | 1.7 | — |
| 1,2 propanediol | 4 | 4.6 | 2.4 | 3.9 | 2 | 0.5 |
| Borax | 3 | 3 | 2 | 1.9 | 1.3 | — |
| Polyacrylate | — | — | — | — | 0.1 | 0.3 |
| Polyacrylate copolymer[2] | — | — | — | — | 0.5 | — |
| Sodium carbonate | — | — | — | — | 0.3 | — |
| Sodium silicate | — | — | — | — | — | 2.6 |

TABLE 2-continued

Other liquid detergent compositions according to the invention.
Table 1

| Ingredient | Percentage by weight of composition | | | | | |
|---|---|---|---|---|---|---|
| | G | H | I | J | K | L |
| Hydrogenated castor oil derivative structurant | 0.3 | 0.2 | 0.2 | 0.3 | 0.2 | 0.1 |
| Boric acid | 1.5 | 2 | 2 | 1.5 | 1.5 | 0.5 |
| Perfume | 0.5 | 0.5 | 0.5 | 0.6 | 0.8 | 0.6 |
| Water, dyes and miscellaneous | Balance | | | | | |

[1]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.
[2]Alco 725 (styrene/acrylate)

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry detergent composition comprising:

a. an amphiphilic graft polymer based on water-soluble polyalkylene oxides as a graft base and side chains formed by polymerization of a vinyl ester component, said polymer having an average of greater than zero to less than or equal to 0.5 graft site per 50 alkylene oxide units and a mean molar mass of from about 3,000 to about 100,000;

b. from about 0.2% to about 8%, by weight of the laundry detergent composition, of an organic solvent; and c. from about 2% to about 20%, by weight of the laundry detergent composition, of a surfactant system;

wherein said laundry detergent composition is in a form selected from the group consisting of liquid, gel, and combinations thereof.

2. The laundry detergent composition of claim 1, wherein said amphiphilic graft polymer has a polydispersity of less than or equal to about 3.

3. The laundry detergent composition of claim 1, wherein said detergent composition is anisotropic.

4. The laundry detergent composition of claim 1, wherein said detergent composition further comprises an aqueous liquid matrix and structurant.

5. The laundry detergent composition of claim 4, wherein said structurant is an organic external structurant selected from the group consisting of a) non-polymeric crystalline, hydroxy-functional materials which form thread-like structuring systems throughout the aqueous liquid matrix of said detergent composition upon in situ crystallization therein;

b) polymeric structurants selected from polyacrylates, polymeric gums, other non-gum polysaccharides, and combinations thereof; wherein said polymeric structurants imparting shear thinning characteristics to the aqueous liquid matrix of said detergent composition;

c) any other structurant which imparts to the aqueous liquid matrix of said detergent composition:

i) a pouring viscosity at 20 $sec^{-1}$ of from about 100 centipoises to about 2500 centipoises, ii) a viscosity at constant low stress of about 0.1 Pascal which is at least about 1500 centipoises; and iii) a ratio of said constant low stress viscosity to said pouring viscosity of at least about 2; and d) combinations thereof.

6. The laundry detergent composition of claim 1, wherein said organic solvent is liquid at room temperature and consists essentially of atoms selected from carbon; hydrogen; oxygen; and combinations thereof.

7. The laundry detergent composition of claim 6, wherein said organic solvent is selected from the group consisting of ethanol; 1,2 propanediol; glycerol; diethylene glycol; 2-methyl 1,3 propanediol; and combinations thereof.

8. The laundry detergent composition of claim 1, wherein said surfactant system comprises anionic surfactant selected from the group consisting of linear alkylbenzene sulfonic acid; branched alkybenzene sulfonic acid; C12 to C18 alkylsulfate; C12-C18 alkyl alkoxy sulfate; C12-C18 alkyl methyl ester sulfonate and combinations thereof.

9. The laundry detergent composition of claim 8, said surfactant system further comprising amphoteric surfactant.

10. The laundry detergent composition of claim 1, further comprising from about 0.1% to about 3% by weight of the laundry detergent compositions of anionic hydrotrope.

11. A laundry detergent composition comprising:

a. a hydrophilic soil removal polymer;

b. amphiphilic graft polymer based on water-soluble polyalkylene oxides as a graft base and side chains formed by polymerization of a vinyl ester component, said polymer having an average of greater than zero to less than or equal to 0.5 graft site per 50 alkylene oxide units and a mean molar mass of from about 3,000 to about 100,000;

c. from about 0.2% to about 8% of organic solvent; and d. from about 2% to about 40% of a surfactant system;

wherein said laundry detergent composition is in a form selected from the group consisting of liquid, gel, and combinations thereof.

12. The laundry detergent composition of claim 11 wherein the hydrophilic soil removal polymer comprises:

a. a backbone comprising oligoamine, polyamine, or polyimine; and b. at least one polyalkoxylated side chain.

13. The laundry detergent composition of claim 11 wherein the hydrophilic soil removal polymer is a polymer comprising polyacrylic acid monomers having a number average molecular weight of from about 1000 to about 10,000 amu and a polydispersity of less than about 5.

14. The laundry detergent composition of claim 12, wherein said hydrophilic soil removal polymer is selected from the group consisting of ethoxylated oligoamines, ethoxylated oligoamine methyl quats, ethoxylated oligoamine benzyl quats, ethoxylated oligoamine methyl quats, propoxylated-ethoxylated oligoamine methyl quats, ethoxysulfated oligoamine benzyl quats, propoxylated-ethoxysulfated oligoamine benzyl quats, ethoxylated oligoetheramine methyl quats, ethoxylated oligoetheramine benzyl quats, ethoxysulfated oligoetheramine methyl quats, ethoxysulfated oligoetheramine benzyl quats, ethoxylated polyethyleneimines, ethoxylated polyethyleneimines quats, ethoxylated-propoxylated polyethyleneimines, and combinations thereof.

15. The laundry detergent composition of claim 14, wherein said amphiphilic graft polymer and said hydrophilic soil removal polymer are present in said detergent composition at a weight percentage ratio of from about 95:5 to about 10:90.

16. The laundry detergent composition of claim 14, wherein the hydrophilic soil removal polymer is selected from the group consisting of ethoxysulfated hexamethylene diamine dimethyl quat; ethoxylated tetraethylene pentaimine; ethoxylated hexamethylene diamine dimethyl quat; bis(hexamethylene)triamine ethoxylated about 30 times per —NH group and about 90% quaternized; ethoxylated 4,9-dioxa-1,12-dodecanediamine dimethyl quat tetrasulfate; propoxylated-ethoxylated and benzyl-quaternized and trans-sulfated bis(hexamethylene)triamine; 50% sulfonated, propoxylated, ethoxylated methyl quat of hexamethylene diamine; ethoxylated polyethylene imine having an average of about 20 ethoxylations per —NH group; ethoxylated polyethylene imine having an average of about 7 ethoxylations per —NH group; and combinations thereof.

17. The laundry detergent composition of claim 11, wherein said surfactant system comprises anionic surfactant selected from the group consisting of linear alkylbenzene sulfonic acid; branched alkybenzene sulfonic acid; C12 to C18 alkylsulfate; C12-C18 alkyl alkoxy sulfate; C12-C18 alkyl methyl ester sulfonate and combinations thereof.

18. The laundry detergent composition of claim 17, further comprising from about 0.001% to about 1%, by weight of the detergent composition, of a cationic coacervating polymer.

19. The laundry detergent composition of claim 18, wherein said cationic coacervating polymer is selected from the group consisting of cationic hydroxyl ethyl cellulose; polyquaternium polymers; and combinations thereof.

20. A laundry detergent composition comprising by weight percentage of said composition:

a. from about 0.1% to about 5% of amphiphilic graft polymer based on water-soluble polyalkylene oxides as a graft base and side chains formed by polymerization of a vinyl ester component, said polymer having an average of greater than zero to less than or equal to 0.5 graft site per 50 alkylene oxide units and a mean molar mass of from about 3,000 to about 100,000;

b. from about 0.1% to about 4% of a hydrophilic soil removal polymer;

c. from about 0.5% to about 5% of organic solvent;

d. from about 5% to about 15% of alkylbenzene sulfonic acid;

wherein said detergent composition is in a form selected from: anisotropic liquid; anisotropic gel; and combinations thereof.

* * * * *

UNITED STATES PATENT AND TRADEMARK OFFICE

CERTIFICATE OF CORRECTION

PATENT NO. : 7,951,768 B2
APPLICATION NO. : 12/147864
DATED : May 31, 2011
INVENTOR(S) : Jean-Pol Boutique et al.

It is certified that error appears in the above-identified patent and that said Letters Patent is hereby corrected as shown below:

Column 3
Line 21, delete "20 $see^{-1}$" and insert --20 $sec^{-1}$--.
Column 10
Line 59, delete "theological" and insert --rheological--.
Line 63, delete "vicosity" and insert --viscosity--.

Signed and Sealed this
Third Day of April, 2012

David J. Kappos

David J. Kappos
*Director of the United States Patent and Trademark Office*